US009151075B2

(12) United States Patent
Duffy et al.

(10) Patent No.: US 9,151,075 B2
(45) Date of Patent: Oct. 6, 2015

(54) FENCE/RAIL ASSEMBLY WITH CONCEALED SLIDING, PIVOTAL CONNECTION, AND MANUFACTURING METHOD THEREFOR

(75) Inventors: Gordon Duffy, Fair Play, SC (US); Jason Duffy, Jefferson, GA (US)

(73) Assignee: BARRETTE OUTDOOR LIVING, INC., Middleburg Heights, OH (US)

( * ) Notice: Subject to any disclaimer, the term of this patent is extended or adjusted under 35 U.S.C. 154(b) by 32 days.

(21) Appl. No.: 12/702,887

(22) Filed: Feb. 9, 2010

(65) Prior Publication Data

US 2010/0200827 A1 Aug. 12, 2010

Related U.S. Application Data

(60) Provisional application No. 61/151,122, filed on Feb. 9, 2009.

(51) Int. Cl.
*E04H 17/00* (2006.01)
*E04H 17/14* (2006.01)

(52) U.S. Cl.
CPC ..... *E04H 17/1439* (2013.01); *Y10T 29/49625* (2015.01); *Y10T 29/49629* (2015.01); *Y10T 29/49826* (2015.01); *Y10T 29/49947* (2015.01)

(58) Field of Classification Search
USPC ..... 256/21, 22, 65.08, 65.11, 65.12
See application file for complete search history.

(56) References Cited

U.S. PATENT DOCUMENTS

| | | | | |
|---|---|---|---|---|
| 2,218,953 | A * | 10/1940 | Gustafson | 256/22 |
| 3,033,532 | A * | 5/1962 | McFall | 256/21 |
| 3,258,251 | A * | 6/1966 | Culter | 256/22 |
| 4,050,828 | A * | 9/1977 | Noro | 403/201 |
| 5,454,548 | A * | 10/1995 | Moore | 256/22 |
| 5,660,378 | A * | 8/1997 | Schall | 256/65.12 |
| 6,375,166 | B1 * | 4/2002 | Schall et al. | 256/65.08 |
| 6,752,386 | B1 * | 6/2004 | Bundy | 256/65.12 |
| 6,863,265 | B2 * | 3/2005 | Perry et al. | 256/65.07 |
| 7,152,849 | B2 * | 12/2006 | Graber | 256/22 |
| 7,384,025 | B2 * | 6/2008 | Lo | 256/65.08 |
| 7,543,802 | B2 * | 6/2009 | Petta et al. | 256/65.08 |
| 7,677,535 | B1 * | 3/2010 | Lo | 256/65.08 |
| 2009/0026431 | A1 * | 1/2009 | Tremblay et al. | 256/65.03 |
| 2009/0065755 | A1 * | 3/2009 | Sherstad | 256/22 |
| 2010/0065802 | A1 * | 3/2010 | Lo | 256/65.12 |
| 2010/0264388 | A1 * | 10/2010 | Duffy et al. | 256/22 |
| 2011/0001105 | A1 * | 1/2011 | Lo | 256/65.08 |
| 2011/0042637 | A1 * | 2/2011 | Howard et al. | 256/22 |
| 2011/0155982 | A1 * | 6/2011 | Duffy et al. | 256/22 |

FOREIGN PATENT DOCUMENTS

WO 2007/119039 A1 10/2007

* cited by examiner

*Primary Examiner* — Daniel Wiley

(74) *Attorney, Agent, or Firm* — Gardner Groff Groff & Villanueva, PC

(57) ABSTRACT

A fencing/railing assembly adapted to be positioned between a pair of posts and mounted thereto includes a plurality of pickets, a plurality of rails extending transverse to the pickets, and one or more pivoting, sliding connectors for connecting a picket to a rail, with the sliding, pivotal connection concealed by the rail. The connector is slidably mounted to the rail and is pivotally connected to the picket. In one embodiment, an elongated connector strip is concealed by the rail and spans multiple pickets. In another embodiment, the assembly includes a plurality of shorter connectors, one for each picket/rail connection.

20 Claims, 6 Drawing Sheets

FENCE/RAIL ASSEMBLY WITH CONCEALED SLIDING, PIVOTAL CONNECTION, AND MANUFACTURING METHOD THEREFOR

CROSS-REFERENCE TO RELATED APPLICATION

This application claims the priority benefit of U.S. Provisional Patent Application Ser. No. 61/151,122, filed Feb. 9, 2009, the entire scope and content of which is hereby incorporated herein by reference.

BACKGROUND

The present invention in general relates to fencing and railing systems, and in particular relates to connectors for fencing and railing systems.

SUMMARY

Briefly described, in a first example embodiment the present invention relates to a fencing/railing assembly adapted to be positioned between a pair of posts and mounted thereto. The assembly includes a plurality of pickets, a plurality of rails extending transverse to the pickets, and a connection between the pickets and the rails. The picket/rail connection is slidably mounted to the rail and pivotally connected to the picket to permit a sliding, pivotal motion. The sliding, pivotal connection allows the pickets to be oriented at greater angles relative to the rails (i.e., it allows the assembly to rack to a greater degree, thereby allowing the fencing/raining to follow more steeply changing terrain or contours).

In one preferred form, the fencing/railing assembly includes one or more elongated connector strips that are each concealed by the rail and that each span a corresponding set of multiple adjacent pickets. In another preferred form, the fencing/railing assembly includes a plurality of shorter connectors, one for each picket/rail connection.

The connectors, be they shorter individual-picket connectors or longer multi-picket connector strips, can include small projections (e.g., bosses) that extend from one surface thereof and engage holes (e.g., recesses) formed in the pickets. Advantageously, this provides a fastener-less but still pivotal connection. Preferably, the rails each have an inner profile that is sized and shaped to slidably retain or capture the connector between the rail and the picket, while permitting the connector strip to slide relative to the rail and be concealed by the rail during normal use. For example, the rail can have an inwardly extending shelf or ledge that slidingly supports the connector strip so that the connector strip slides atop the shelf.

The fencing/railing assembly, including the pickets, the rails, and the concealed connectors, can be made of extruded aluminum, plastic, or other materials. Also, the rails can be generally U-shaped and have picket openings formed in one portion thereof for receiving the pickets therethrough. Optionally, a leading, inner edge of the railing may be beveled or eased to facilitate slipping the rail over the connector during assembly.

In another aspect, the present invention relates to a pre-assembled fencing/railing assembly adapted to be positioned between a pair of posts and mounted thereto. The assembly includes the same components as those described above. But these components are pre-assembled at a factory or other assembling facility. And the assembly is shipped in this pre-assembled state, ready for installation, so this part of the assembly process is not done on-site in the field.

In yet another aspect, the present invention relates to a method of manufacturing a fencing/railing assembly to be positioned between a pair of posts and mounted thereto. One such example method includes the steps of: (a) providing a series of pickets each with one or more connector holes formed therein; (b) providing a connector strip with a series of connector bosses formed on at least one side thereof; (c) attaching the connector strip to the series of pickets by aligning and inserting the connector bosses into the connector holes formed in the pickets; (d) providing an at least three-sided rail (e.g., a generally U-shaped rail) with picket openings formed in an upper portion thereof; and (e) slipping the rail over the pickets and over the connector strip to secure the connector strip in place and conceal the connector strip.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION

Figures 1, 2:
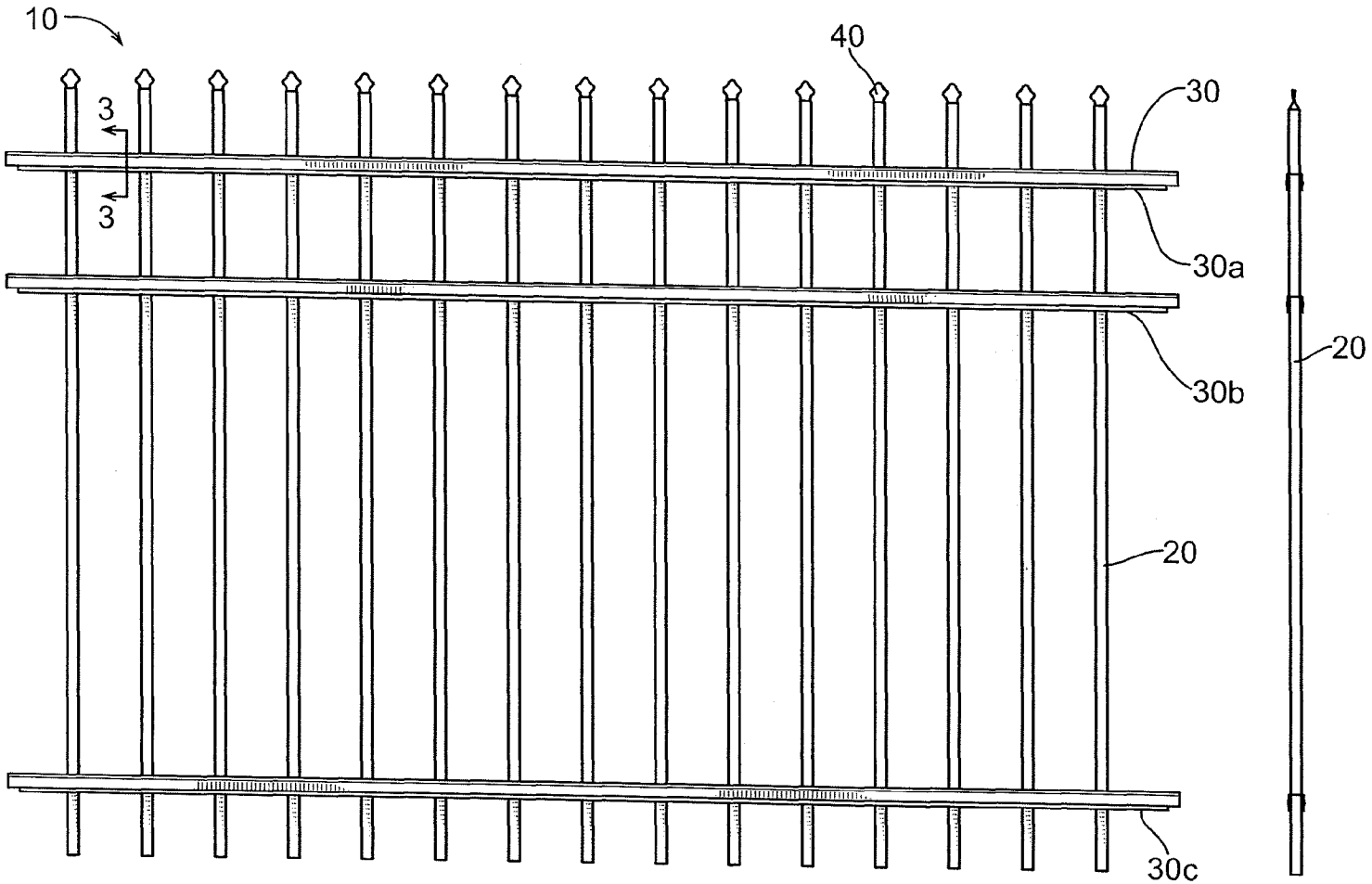
FIG. 1 is a front elevation view of a fencing/railing assembly according to a first example embodiment of the present invention.
FIG. 2 is a side view of the fencing/railing assembly of FIG. 1.

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Referring now in detail to the drawing figures, wherein like reference numerals represent like parts throughout the several views, FIGS. 1-6E and 7C-7D show a fencing and/or railing assembly 10 according to a first example embodiment of the present invention. The railing assembly 10 is typically used to enclose yard spaces, decks, porches and the like.

Generally, the railing assembly 10 comprises a plurality of horizontally spaced pickets 20 and at least one support rail 30. The pickets 20 are typically arranged generally vertically with the rail 30 transverse to them. In the depicted embodiment, the railing assembly comprises three support rails 30*a*, 30*b*, 30*c* (as seen in FIG. 1) to space, align, and secure the pickets 20 and to provide for structural rigidity. Each picket 20 can also include an endcap 40 coupled to the top of the same (or formed in the top portion itself) to close off the top of the picket and/or to provide a decorative element to the railing assembly 10. In example embodiments, the pickets 20 and railing 30 are formed from extruded aluminum, however, in alternative embodiments, the pickets and railing can be formed from solid aluminum, other metals and/or metal alloys, wood, rubber, plastic, and/or other materials known in the art. In example embodiments, the pickets 20 are hollow, square aluminum extrusions and the railings 30 roughly rectangular (but U-shaped) aluminum extrusions; however, in alternative embodiments, the pickets and railing can be formed in different shapes.

Figure 3:
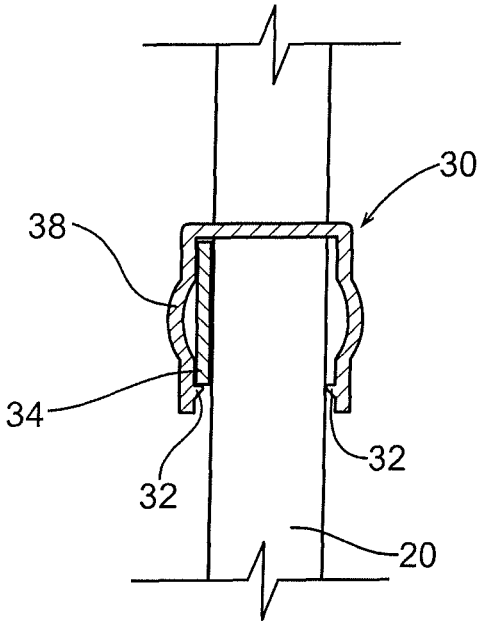
FIG. 3 is a side sectional view of a portion of the fencing/railing assembly taken at line 3-3 of FIG. 1.
Figure 4:
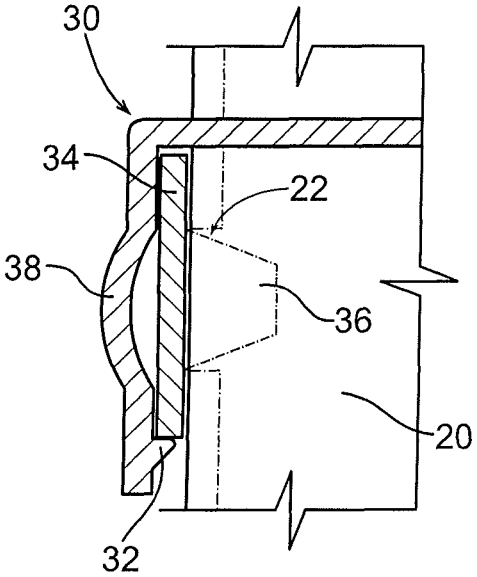
FIG. 4 shows the left portion of the fencing/railing assembly of FIG. 3, with hidden features shown in phantom lines.

As seen in FIGS. 3 and 4, the rails 30 can have a substantially "U" shaped cross-section and, in use, are generally oriented open-side-down such that the "bottom" of the "U" forms the top of the rail 30. In alternative embodiments, the rails 30 can have a substantially "J" shaped cross-section or rectangular-shaped cross-section. In still other embodiments, the rails 30 can include other cross-section shapes as desired. The top wall of the rail 30 includes a series of horizontally spaced picket openings 39 through which the pickets extend. In depicted example embodiments the rail 30 is shown having a decorative bulge 38 on the exterior surface of the rail, however, in alternative example embodiments other exterior shapes can be utilized as desired.

As shown in FIGS. 3 and 4, the rails 30 include at least one concealed ledge or shelf 32 for supporting a connector or boss strip 34 (or alternatively referred to as a dimpled strip) thereon. The shelf or shelves 32 extend inwardly from the inner surface of one or both sidewalls of the rail 30. Optionally, the lower leading edges of the shelf 32 (or another portion of the rail 30) can be chamfered, ramped, or beveled to facilitate a slight outward deflection and smooth movement over the boss strip 34 during assembly. Once in place, the boss strip 34 is securely held there by the shelf 32 with the boss strip supported by the shelf and secured in place between the shelf and the top wall of the rail 30. The boss strip 34 is captured between the corresponding sidewall of the rail 30 and the picket 20 but permitted to slide horizontally between the two and along the rail atop the shelf 32. Additionally, the connector strip 34 can be made of a metal, plastic, or any other suitable material.

Figure 7A:
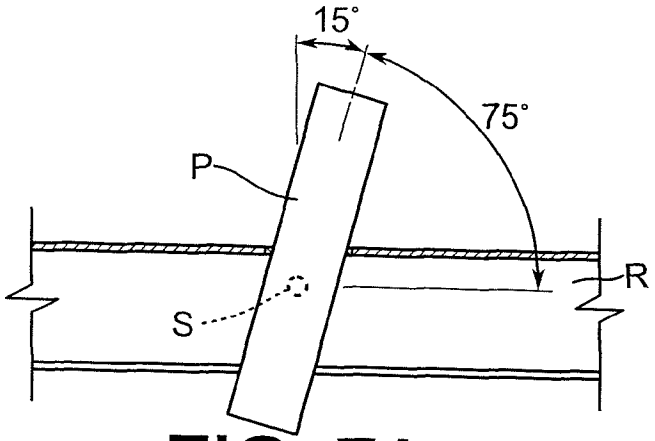
FIG. 7A (Prior Art)
FIGS. 7A-7B are schematic illustrations depicting the range of movement of a prior art picket-and-rail arrangement.
Figure 7B:
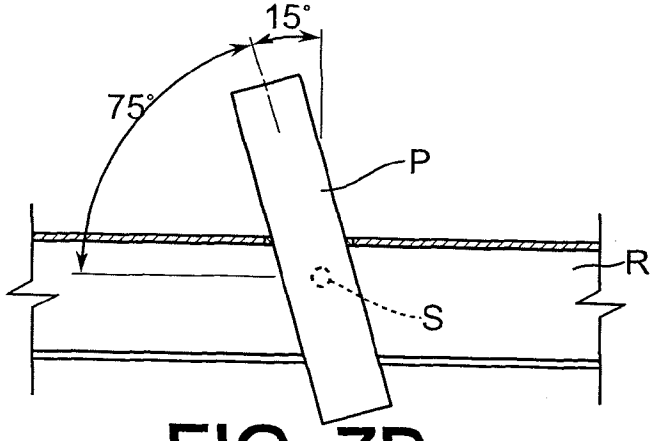
FIG. 7B (Prior Art)
Figure 7C:
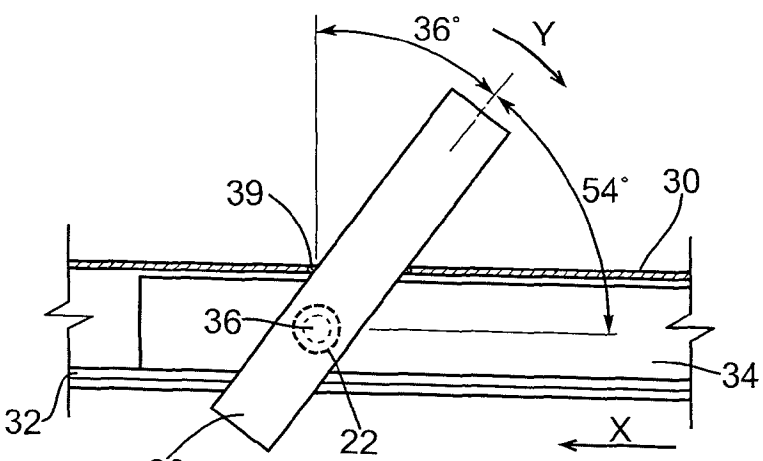
FIGS. 7C-7D are schematic illustrations depicting the range of movement of a picket-and-rail arrangement of the fencing/railing assembly of FIGURE
Figure 7D:
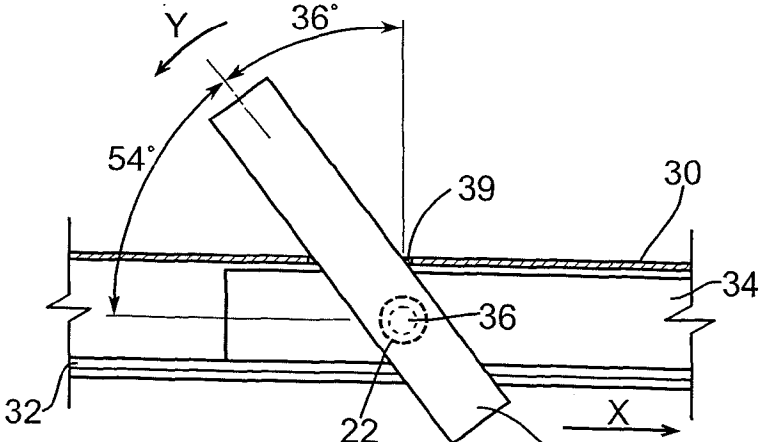
Figure 12:
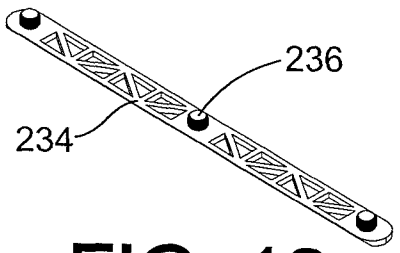
FIGS. 9-12 are plan, side, bottom, and perspective views of a connector boss strip of a fencing/railing assembly according to a third example embodiment of the invention.
Figure 13:
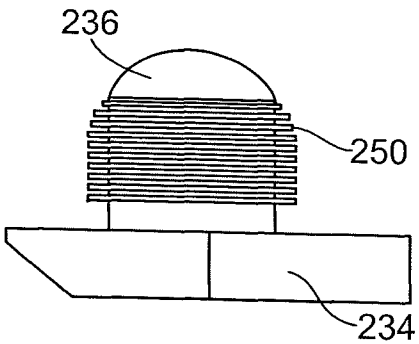
FIG. 13 is a side view of a boss of the connector boss strip of FIG. 10.
Figure 9:
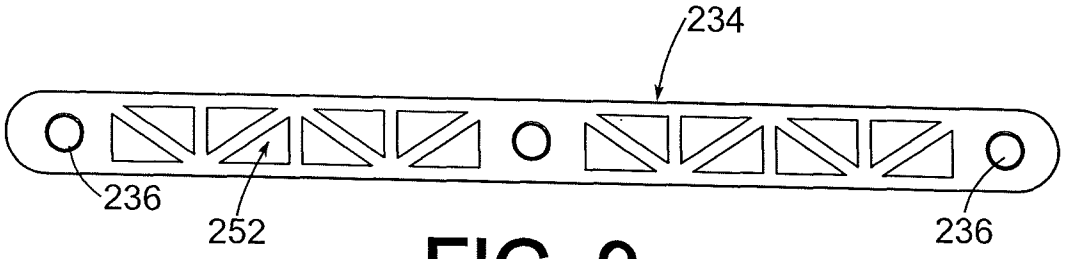
Figure 10:
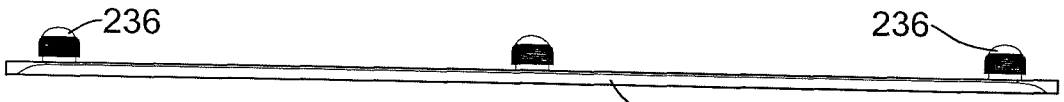
Figure 11:
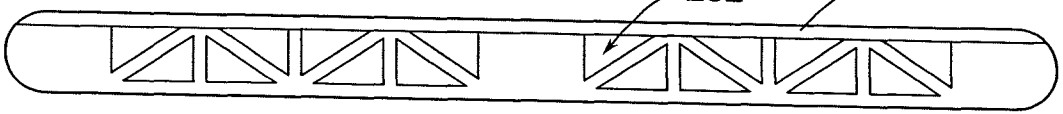

In addition, the boss strip 34 includes at least one inwardly extending boss (e.g., a nub, pin, or other protruding structure) 36 that is received in a pivot or connector hole 22 (e.g., a recess or through-hole) in one of the pickets 20 for rotatably coupling the boss strip to that picket (as will be described in greater detail below with reference to FIGS. 7C-7D). In an alternative embodiment, the boss/nub extends outward from the picket and the pivot hole is formed in the connector strip (this is an "opposite" or "vice versa" arrangement of that described above). In another alternative embodiment, aligning pivot holes are formed in the connector strip and the picket, a pivot pin is provided, and the two ends of the pivot pin are inserted into the two pivot holes. In yet another alternative embodiment, the pivot hole is horizontally slotted to provide for additional sliding motion.

And in still another alternative embodiment, the connector/boss strip is eliminated, the pickets each include at least one horizontally slotted connector hole, and the rails each include at least one inwardly extending boss that is received into the slotted connector hole. In this embodiment, the pickets pivot about the boss and the boss slides along the slotted connector hole such that the rail/boss and picket slide too. The opposite or vice versa arrangement can alternatively be provided, with the boss on the pickets and the slots in the pickets. As no connector strips are provided, and the strips in the above-described embodiments provide structural support for the overall fence/railing assembly, the rails and/or pickets of this embodiment are designed with relatively greater strength (e.g., a stronger material and/or thicker walls).

Thus, the railings 30 each have an inner profile that is sized and shaped to retain the connector or boss strip 34 between the rail and the picket while permitting it to slide and pivot relative to the pickets. With this construction, a sliding, pivoting connection is obtained and also concealed. The connection is also achieved without the use of any threaded fasteners.

Figure 5:
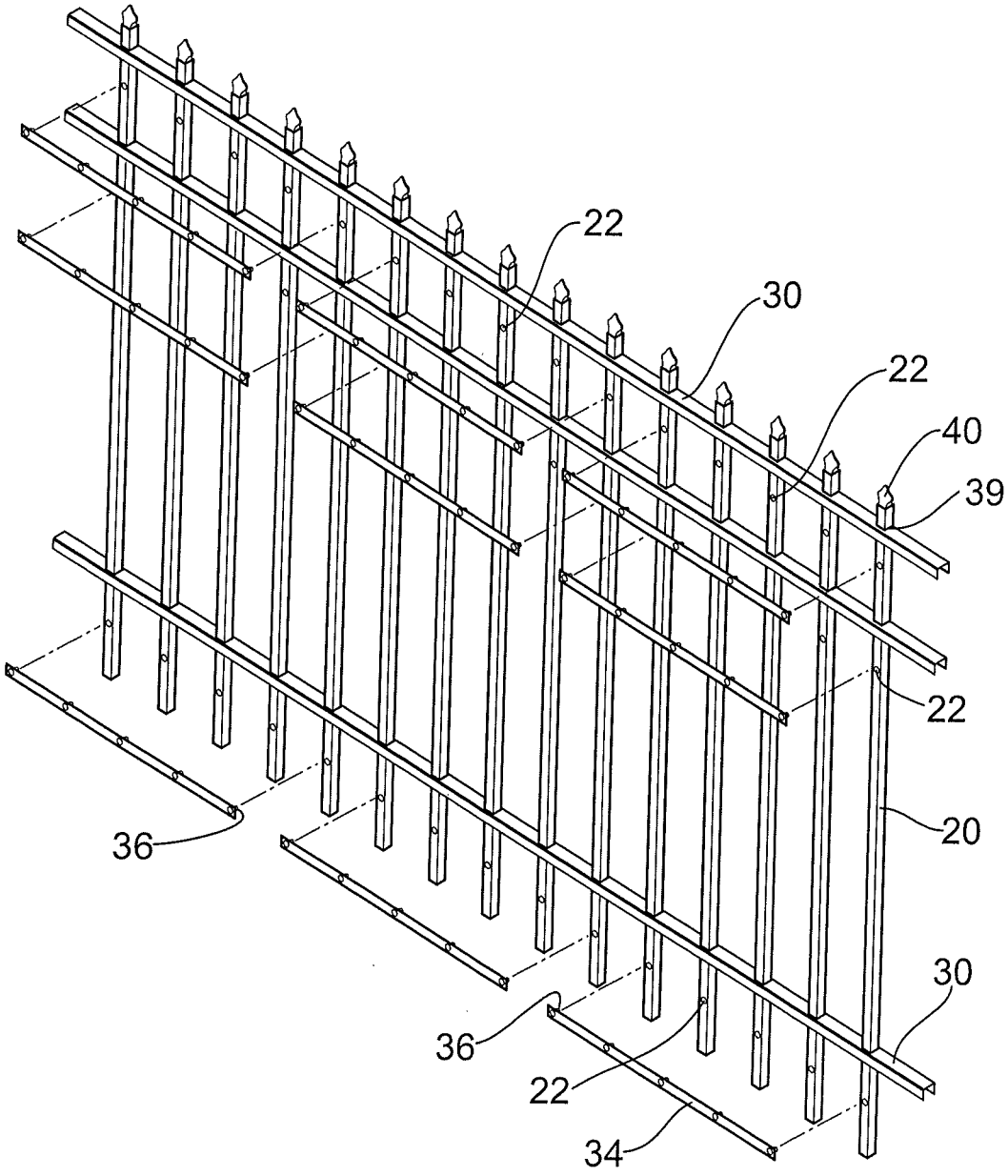
FIG. 5 is a perspective, exploded view of the fencing/railing assembly of FIG. 1, depicting the fencing/railing assembly being assembled.
Figure 6A:
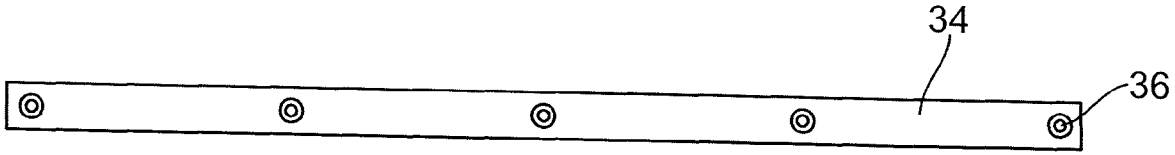
FIGS. 6A-6E are front, top, back, side, and perspective views of a connector strip of the fencing/railing assembly of FIG. 1.
Figure 6E:
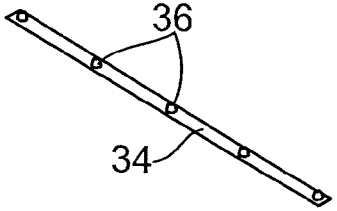
Figure 6B:
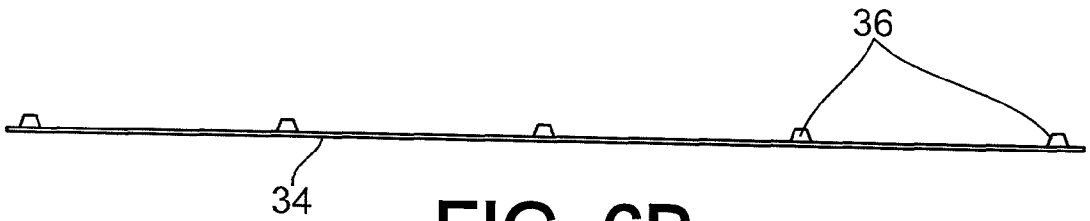
Figure 6D:
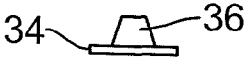
Figure 6C:
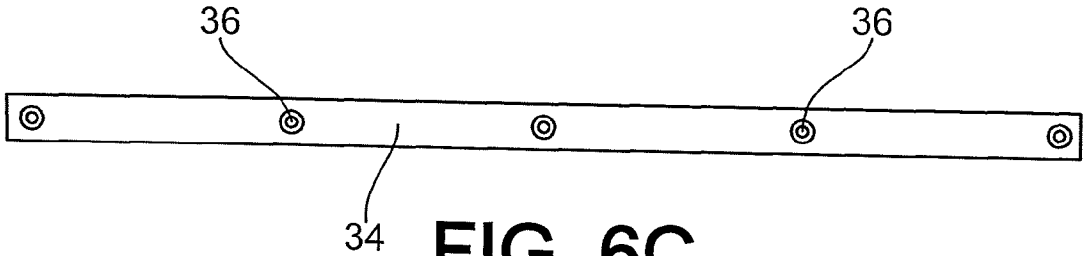

In use, the railing assembly 10 can be assembled as partially demonstrated in FIG. 5. For example, the plurality of pickets 20 are first inserted into and extended through the picket openings 39 of the rails 30. Next, the connector or boss strips 34 (better seen and understood by viewing FIGS. 6A-6E) are coupled to pickets 20 by inserting the bosses/nubs 36 into the corresponding holes 22 formed in the pickets. Finally, the rails 30 are lowered (from the depicted positions of FIG. 5) vertically along the pickets 20 and over the boss strips 34, where they are snapped into place by forcing each rail ledge or shelf 32 over the boss strip, for example, by the beveled or ramped leading edge riding over the strip and deflecting slightly thereby.

As shown in FIG. 5, multiple connector boss strips 34 can be used with each rail in the railing assembly 10, with each boss strip being long enough that it is coupled to a set of multiple of the pickets 20. The set of pickets can include all of the pickets 20 in a fence/rail section (between posts) or only some of them. In the typical commercial embodiment depicted, each boss strip is long enough that it is coupled to approximately five pickets 20, and thus it has five bosses/nubs 36. This coordinates together the pivoting of all of the pickets 20 engaged by a connector strip 34 (those in the picket set) relative to the rail 30 and that connector strip 34. For example, if a connector strip 34 were to be in engagement with five pickets 20, movement of a single picket amongst the five pickets would result in the other four pickets moving in synchronization with the single picket that is originally moved. In addition, by spanning multiple pickets 20, the connector strips 34 provide structural support for the overall fence/rail assembly 10, so the pickets and/or rails 30 can be designed to provide less overall structural strength (e.g., with thinner walls and/or less-strong materials).

Figure 8:
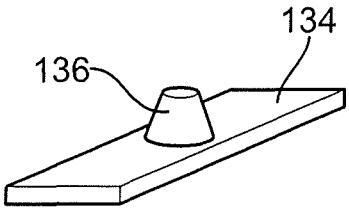
FIG. 8 is a perspective view of a connector of a fencing/railing assembly according to a second example embodiment of the invention.

In alternative embodiments, longer or shorter boss strips 34 can be utilized as desired, such that each boss strip can accommodate less than five pickets or more than five pickets. In still other alternative embodiments, a relatively short, single boss strip or connector is used for each picket/rail connection. As seen in FIG. 8, for example, a short boss or connector strip 134 according to a second example embodiment is so short that it doesn't span from one picket to another and it only includes a single boss/nub 136.

In manufacturing the product, a simplified technique or method is accomplished. In an example method, a pre-assembled section of fencing/railing assembly is constructed and shipped for sale. This allows the sections to be assembled under factory conditions, rather than under field conditions, for maximum efficiency and quality control. The pre-assembled fencing/railing assembly includes a length of fencing/railing ready to be installed between a pair of posts or uprights. Thus, the user would install the pre-assembled section of fencing/railing between the posts in the field.

The manufacturing method for constructing the pre-assembled section can include the steps of:

(a) providing a series of pickets with connector holes formed therein;

(b) providing at least one connector strip with one or a series of connector bosses formed on at least one side thereof;

(c) attaching the connector strip to the one or series of pickets by aligning and inserting the connector bosses into the connector holes formed in the pickets;

(d) providing a rail with picket openings formed in an upper portion thereof and with at least one shelf formed on an inner surface thereof; and (e) slipping the rail over the pickets (with the pickets extending through the picket openings) and over the connector strip to secure the connector strip in place on the shelf and conceal the connector strip.

This manufacturing method allows for easy and economical manufacture, as well as providing a consistently good manufacturing quality. Also, when the pre-assembled section of fencing/railing is assembled, the connector strip is not readily visible (it is concealed by the rail).

In addition to concealing the connection and being readily pre-assembled in a factory for later field-installation by a user, a fencing/railing assembly according to the present invention also adjusts to follow rising or falling terrain better than known fencing/railing. As demonstrated by comparing a known prior art railing assembly (FIGS. 7A-7B) to the present invention (FIGS. 7C-7D), it can be seen that the present invention is better able to pivot the pickets relative to the rails in comparison to known railing assemblies. For instance, known railing assemblies incorporate screws S and/or bolts to rotatably couple pickets P to rails R, as shown in FIGS. 7A-7B. Such couplings are time consuming to install and only allow for a limited range of rotation and little if any horizontal movement. In fact, the known railing assembly of FIGS. 7A-7B only allows the pickets to rotate about 15 degrees in either direction before being obstructed by the edge of the picket opening.

In stark contrast, the present invention utilizes a sliding pivotal connection between the pickets 20 and the rails 30 that is very easy and fast to install and allows for limited horizontal movement of the pickets 20 along the rails 30. In particular, the connector boss strip 34 slides within the rail 30 in the transverse directions denoted by the arrows X when the pickets 20 are pivoted in the angular directions denoted by the arrows Y, thereby allowing the pivot point between the connector hole 22 of the picket and the rail to slide one way or the other, as shown in FIGS. 7C-7D. Because of this, the picket 20 is afforded a higher degree of rotation within the picket openings 39 of the rail, while the pickets and picket openings are the same size as in prior art systems. In typical commercial embodiments, utilizing the present invention permits the pickets 20 to rotate about the boss 36 at least 36 degrees (as compared to the known railing assembly's typical rotational limit of about 15 degrees), using a similar opening gap between the picket and the edge of the picket opening in the railing—the additional freedom of motion is not due to simply making the opening larger. The amount of rotation depicted in FIGS. 7C-7D is meant to be exemplary of the capabilities of the present invention and is in no way meant to limit the scope of the present invention.

The above-described embodiments can be provided pre-assembled, with the cost of the materials and assembly being about the same as the prior art systems unassembled. Alternatively, the above-described embodiments can be provided unassembled and assembled on-site in the field during installation.

FIGS. 9-13 show a connector or boss strip 234 of a fence/rail assembly according to a third example embodiment of the invention. The connector boss strip 234 can be used in fence/rail assemblies that are pre-assembled or field-assembled. In this embodiment, the connector boss strip 234 includes bosses 236 with ribs 250 that better secure the bosses into the connector holes of the pickets. This is particularly beneficial when used in fence/rail assemblies that are field-assembled. In addition, the connector boss strip 234 includes internal openings 252 that reduce the amount of material used without reducing the structural integrity of the connector strips. It will be understood that the dimensions shows in FIGS. 9-13 are representative of typical commercial embodiments and are not limiting of the invention; the connector boss strip 234 can be provided with other dimension ins larger or smaller sizes.

While the invention has been described with reference to preferred and example embodiments, it will be understood by those skilled in the art that a variety of modifications, additions and deletions are within the scope of the invention, as defined by the following claims.

What is claimed is:

1. A fencing/railing assembly adapted to be positioned between a pair of posts and mounted thereto, the assembly comprising:

a plurality of vertical pickets, each picket comprising an upper end and a lower end opposite the upper end, each picket further comprising at least one pivot hole formed therein between the upper and lower ends;

a plurality of elongate rails extending transverse to the pickets, each rail having a first end and a second end opposite the first end, and having at least an upper wall and a side wall, each rail further comprising a plurality of picket openings formed therein and spaced longitudinally along the upper wall thereof, wherein the plurality of pickets are each individually received in a respective one of the plurality of picket openings; and one or more connectors for connecting the plurality of pickets to the plurality of rails, each connector comprising an elongate strip with opposing first and second sides, wherein at least one boss extends from the first side of the strip, and a sliding surface is formed on the second side;

wherein the at least one boss of each connector is inserted into the at least one pivot hole in a respective one of the plurality of pickets such that the connector is pivotably connected to the picket, and wherein the sliding surface of each connector is slidably engaged with an inner surface of the side wall of a respective one of the plurality of rails, wherein each connector provides a pivotal connection to the respective picket to permit a pivoting motion therebetween, and a slidable connection to the respective rail to permit a sliding motion therebetween, to permit a combination pivoting and sliding motion between the rail and the picket, and whereby pivoting the upper end of the respective picket towards the first end of the respective rail causes the respective connector to slide along the inner surface of the side wall of the respective rail towards the second end of the respective rail, and vice versa, in such a manner that a pivotal range of the plurality of pickets relative to the plurality of rails is at least about 20 degrees in each direction.

2. A fencing/railing assembly as claimed in claim 1, wherein the pivotal range of the plurality of pickets relative to the plurality of rails is at least about 25 degrees in each direction.

3. A fencing/railing assembly as claimed in claim 1, wherein the pivotal range of the plurality of pickets relative to the plurality of rails is at least about 30 degrees in each direction.

4. A fencing/railing assembly as claimed in claim 1, wherein the pivotal range of the plurality of pickets relative to the plurality of rails is at least about 35 degrees in each direction.

5. A fencing/railing assembly as claimed in claim 1, wherein each at least one boss includes a circular nub and each at least one pivot hole includes a circular opening for receiving the at least one nub such that the pivotal range of the pickets relative to the rails is not limited by interaction of the connector strips with the pickets.

6. A fencing/railing assembly as claimed in claim 1, wherein the connector strips are sized to span multiple of the pickets.

7. A fencing/railing assembly as claimed in claim 6, wherein the connector strips each have a series of the bosses formed at regular spaced-apart intervals.

8. A fencing/railing assembly as claimed in claim 1, wherein the rails each have an inner profile that is sized and shaped to retain the connector strips between the rails and the pickets.

9. A fencing/railing assembly as claimed in claim 8, wherein the rails each have an inwardly-extending shelf that supports the connector strips and permits the sliding motion therebetween.

10. A fencing/railing assembly as claimed in claim 1, wherein the pickets, the rails, and the connector strips comprise aluminum extrusions.

11. A fencing/railing assembly as claimed in claim 1, wherein the pickets have a rectangular cross-section.

12. A fencing/railing assembly as claimed in claim 1, wherein the rails are generally U-shaped.

13. A fencing/railing assembly as claimed in claim 1, wherein the pivotal connection of each connector to the respective picket permits pivoting of the connector relative to the respective picket but not sliding of the connector relative to the respective picket.

14. A fencing/railing assembly as claimed in claim 1, wherein the sliding connection of each connector to the respective rail permits sliding of the connector relative to the respective rail but not pivoting of the connector relative to the respective rail.

15. A fencing/railing assembly as claimed in claim 1, wherein the pivotal range of the plurality of pickets relative to the plurality of rails is attained by the combination pivoting and sliding motion therebetween resulting from a combination of the pivoting motion between the connectors relative to the pickets and the sliding motion of the connectors relative to the rails.

16. A fencing/railing assembly as claimed in claim 1, wherein each boss includes at least one rib to retain the boss in the respective pivot hole of the respective picket.

17. A fencing/railing assembly as claimed in claim 1, wherein, when assembled, each connector is concealed by the rail so that it is not visible except from below.

18. A fencing/railing assembly as claimed in claim 1, wherein a leading, inner edge of each rail is beveled to facilitate slipping the rail over the connector strip while the connector strip is connected to the pickets.

19. A fencing/railing assembly adapted to be positioned between a pair of posts and mounted thereto, the assembly comprising:

a plurality of vertical pickets, each picket comprising an upper end and a lower end opposite the upper end, each picket further comprising a plurality of holes formed therein between the upper and lower ends;

a plurality of elongate rails extending transverse to the pickets, each rail having a first end and a second end opposite the first end, and having at least an upper wall and a side wall, each rail further comprising a plurality of picket openings formed therein and spaced longitudinally along the upper wall thereof, wherein the plurality of pickets are each individually received in a respective one of the plurality of picket openings; and a plurality of connectors for connecting the plurality of pickets to the plurality of rails, each connector comprising an elongate strip with opposing first and second sides and sized to span multiple of the pickets, wherein a series of bosses formed at regular spaced-apart intervals extend from the first side of the strip, and a sliding surface is formed on the second side;

wherein each boss of each connector is inserted into a respective one of the pivot holes in a respective one of the plurality of pickets such that the connector is pivotably connected to multiple of the pickets, and wherein the sliding surface of each connector is slidably engaged with an inner surface of the side wall of a respective one of the plurality of rails, wherein each connector provides a pivotal connection to the respective pickets to permit a pivoting motion therebetween, and a slidable connection to the respective rail to permit a sliding motion therebetween, to permit a combination pivoting and sliding motion between the rail and the picket, whereby pivoting the upper end of the respective picket towards the first end of the respective rail causes the respective connector to slide along the inner surface of the side wall of the respective rail towards the second end of the respective rail, and vice versa, in such a manner that a pivotal range of the plurality of pickets relative to the plurality of rails is at least about 20 degrees in each direction, and wherein each boss includes a circular nub and each pivot hole includes a circular opening for receiving the respective nub such that the pivotal range of the pickets relative to the rails is not limited by interaction of the connector strips with the pickets.

20. A fencing/railing assembly as claimed in claim 19, wherein a leading, inner edge of each rail is beveled to facilitate slipping the rail over the respective connector strip while the connector strip is connected to the respective pickets.

* * * * *